US009395080B2

(12) United States Patent
Cool

(10) Patent No.: US 9,395,080 B2
(45) Date of Patent: Jul. 19, 2016

(54) MIXTURE SUPPLY SYSTEM FOR A HOT WATER APPLIANCE, A HOT WATER APPLIANCE COMPRISING SUCH A MIXTURE SUPPLY SYSTEM AND A METHOD FOR MIXING A FUEL AND AN OXIDIZER

(75) Inventor: Peter Jan Cool, Lochem (NL)

(73) Assignee: Intergas Heating Assets B.V., Coevorden (NL)

( * ) Notice: Subject to any disclaimer, the term of this patent is extended or adjusted under 35 U.S.C. 154(b) by 297 days.

(21) Appl. No.: 13/993,595

(22) PCT Filed: Dec. 19, 2011

(86) PCT No.: PCT/NL2011/050860

§ 371 (c)(1),
(2), (4) Date: Sep. 24, 2013

(87) PCT Pub. No.: WO2012/081984

PCT Pub. Date: Jun. 21, 2012

(65) Prior Publication Data

US 2014/0007822 A1 Jan. 9, 2014

(30) Foreign Application Priority Data

Dec. 17, 2010 (NL) ..... 2005880

(51) Int. Cl.

| | |
|---|---|
| ***F23D 14/36*** | (2006.01) |
| ***F23D 14/64*** | (2006.01) |
| ***F23J 11/02*** | (2006.01) |
| ***F23L 5/02*** | (2006.01) |
| ***B01F 15/02*** | (2006.01) |
| ***F23N 1/02*** | (2006.01) |
| ***F24H 1/18*** | (2006.01) |

(52) U.S. Cl.

CPC ..... *F23D 14/36* (2013.01); *B01F 15/0203* (2013.01); *F23D 14/64* (2013.01); *F23J 11/02* (2013.01); *F23L 5/02* (2013.01); *F23N 1/027* (2013.01); *F24H 1/186* (2013.01); *F23N 2033/08* (2013.01)

(58) Field of Classification Search

CPC ..... F23D 14/36; F23D 14/64
USPC ..... 122/17.1; 366/182.1; 431/12
See application file for complete search history.

(56) References Cited

U.S. PATENT DOCUMENTS

| | | | | |
|---|---|---|---|---|
| 4,157,889 A * | 6/1979 | Bonnel | ..... | 431/182 |
| 5,616,011 A * | 4/1997 | Witschi | ..... | 417/366 |
| 5,839,374 A * | 11/1998 | Conner et al. | ..... | 110/162 |

FOREIGN PATENT DOCUMENTS

| | | |
|---|---|---|
| AT | 411927 B | 7/2004 |
| GB | 2214629 A | 9/1989 |

(Continued)

*Primary Examiner* — Alissa Tompkins
*Assistant Examiner* — John Bargero
(74) *Attorney, Agent, or Firm* — Bret E. Field; Bozicevic, Field & Francis LLP

(57) ABSTRACT

The invention relates to a mixture supply system which is adapted for mounting in a hot water appliance and which is adapted to supply a combustible mixture to a burner of the hot water appliance, comprising a fuel feed for a fluid fuel, an oxidizer feed for a fluid oxidizer, a mixing chamber for mixing the fuel and the oxidizer in order to form the combustible mixture, a discharge for discharging the combustible mixture from the mixing chamber and a fan for urging the fuel and oxidizer from the respective feed to the mixing chamber, and urging the mixture therefrom to the discharge, wherein the fan is adapted to act directly on both the fuel and the oxidizer. The fan does not so much make use of an airflow with gas drawn in by a venturi, but gas is supplied separately to the fan.

12 Claims, 5 Drawing Sheets

(56) References Cited

FOREIGN PATENT DOCUMENTS

| | | | |
|---|---|---|---|
| JP | H1089627 | A | 4/1998 |
| JP | 2852871 | B2 | 2/1999 |
| RU | 2187757 | C1 | 8/2002 |
| WO | WO 2005/080871 | A1 | 9/2005 |

* cited by examiner

MIXTURE SUPPLY SYSTEM FOR A HOT WATER APPLIANCE, A HOT WATER APPLIANCE COMPRISING SUCH A MIXTURE SUPPLY SYSTEM AND A METHOD FOR MIXING A FUEL AND AN OXIDIZER

The present invention relates to a mixture supply system which is adapted for mounting in a hot water appliance and which is adapted to supply a combustible mixture to a burner of the hot water appliance.

The present invention further relates to a hot water appliance provided with such a mixture supply system.

Finally, the present invention also relates to a method for mixing a fluid fuel and a fluid oxidizer.

In the present generation of hot water installations use is made of pre-mixed combustion. Gas and air are mixed and supplied by a fan to a burner, where the air/gas mixture is combusted. A frequently applied technique for mixing the gas and the air (FIG. 2) uses a fan 100 which causes a flow 14 of air in an air feed 12. A venturi (shown schematically here as straight pipe part) is arranged in air feed 12. Arranged in the venturi is a gas feed 22 which is connected to a valve/controller known as "gas control block". The flow 14 in the venturi causes an underpressure in the venturi, which underpressure ensures that a gas flow 26 is brought about. When fan 100 rotates more quickly a greater air flow 14 is caused, and thereby a greater underpressure and so a greater inflow 26 of gas. In the shown example the fan is a radial or centrifugal fan and comprises a fan housing 32 in which a blade wheel 34 is rotatably arranged. Blade wheel 34 is driven rotatingly by a motor 40. The blade wheel is arranged on a shaft 36 which forms part of the rotor of motor 40. One or more electric coils 42 are arranged round the rotor. In some embodiments the motor is also placed wholly outside the housing of the fan and the motor shaft then runs inside through the wall of the housing. In fan 100 the axially inflowing air 14 and axially inflowing gas 26 are deflected through 90° and simultaneously mixed by the rotating blade wheel 34. The resulting air/gas mixture is flung outward in radial direction and collected in an outlet 38 which, as is usual, has an increasing diameter in the rotation direction of blade wheel 34 (FIG. 1). Outlet 38 of the fan carries the air/gas mixture to the burner. There are also embodiments wherein the venturi is arranged between the fan and the burner, and the gas supply takes place at that position. The gas control block is then controlled by the air pressure downstream of the fan. This makes essentially no difference in respect of pressure differences between gas and air flow and is thereby a solution with properties similar to the one with a venturi upstream of the fan.

Mixing of the air and the gas takes place directly downstream of the narrowing of the venturi. The mixing ratio of the air/gas mixture is determined mainly by the geometry of the venturi and air feed 12 and gas feed 22. With a good design of the gas and air feeds this is realized such that the offset—the control value of the pressure at the outlet of the gas control block—is negative (in the order of −5 Pa). In that case the gas control block (not shown) only opens at a pressure of about −5 Pa. The offset value of a gas control block can vary in the course of time due to age, and hysteresis and the temperature of the gas control block are also factors here. When the hot water appliance is operating at low power, depending on the venturi and the turndown ratio, an underpressure of between about −30 Pa and −60 Pa is generated by the venturi. The variation of several Pascal in the offset of the gas control block can then soon cause a considerable difference in the air/gas ratio, this having an adverse effect on the efficiency and the emissions (CO and $NO_x$) of the hot water appliance.

By operating at a greater underpressure at the bottom of the range there is a relative decrease in the influence of the offset variation of the gas control block. This could be realized by applying a greater restriction (i.e. a narrower venturi). A drawback of operating at a greater underpressure is that this is related to the greater restriction. A greater restriction causes a greater air resistance, which must be compensated with a fan of greater power. However, a fan with greater power generally also has larger dimensions, is more expensive and consumes more energy.

The object of the present invention is to provide a mixture supply system for a hot water appliance, which at a relatively low heat demand of the hot water appliance still results in a relatively low dependence on the variation of the offset of the gas control block without the above stated drawbacks.

The present invention achieves this object by providing a mixture supply system which is adapted for mounting in a hot water appliance and which is adapted to supply a combustible mixture to a burner of the hot water appliance, comprising:

a fuel feed for a fluid fuel;

an oxidizer feed for a fluid oxidizer;

a mixing chamber for mixing the fuel and the oxidizer in order to form the combustible mixture;

a discharge for discharging the combustible mixture from the mixing chamber; and a fan for urging the fuel and oxidizer from the respective feed to the mixing chamber, and urging the mixture therefrom to the discharge;

wherein the fan is adapted to act directly on both the fuel and the oxidizer. By separating the fuel feed and the oxidizer feed it is possible to apply different geometries for both and to optimize these to the requirements of these feeds. The oxidizer feed is embodied such that a low flow resistance is realized, for instance by selecting a large diameter for the feed. It is hereby possible to use a fan with low power. A larger diameter with less resistance of the air feed further has a favourable effect on the thermo-acoustic behaviour of the boiler.

According to a first embodiment of the invention, the fan comprises a fan chamber provided with a blade wheel;

the fuel feed and the oxidizer feed each debouch in the fan chamber;

the mixing chamber is incorporated in the fan chamber;

the mixture discharge connects to the fan chamber; and the fuel feed and oxidizer feed have separate exits into the fan chamber.

In a further embodiment the mixture supply system further comprises a fuel pump for forcing a fuel flow out of the fuel feed to the mixing chamber. Now that the fuel feed is no longer incorporated in the oxidizer feed, the fuel is no longer extracted from the fuel feed by the venturi effect. It is of course possible to make use of the overpressure with which gas is for instance supplied by the gas mains. It is however recommended for safety reasons to use a gas control block, downstream of which the gas is actively extracted from the gas feed, for instance by a fuel pump.

In a further embodiment the present invention provides a mixture supply system, wherein the fuel flow is mechanically forced.

In a specific embodiment the fuel pump per se comprises another fan. Because a volume part of fuel is generally required which is much smaller than the volume part of the oxidizer (in the combustion of natural gas with air about one part gas to nine parts air), it is possible to suffice with a low-power fan.

In a further embodiment the invention provides a mixture supply system, wherein the fuel pump is incorporated in the fuel feed and wherein the fuel pump is connected by means of a conduit to the mixing chamber.

In yet another embodiment of the mixture supply system the fuel pump is incorporated in the fan chamber.

According to a preferred embodiment of the invention, the fan comprises a fan housing which bounds the fan chamber, wherein the fan housing has two walls located opposite each other and bounding the fan chamber in axial direction; and wherein the fuel feed and the oxidizer feed each debouch in an opposite wall.

In a particularly advantageous embodiment of the mixture supply system the blade wheel is embodied as a double blade wheel adapted such that the one side of the blade wheel substantially pumps the oxidizer and the other side of the blade wheel substantially pumps the fuel. This embodiment is particularly advantageous because the fan need not take as heavy a form as is the case in the prior art mixture supply systems, because the oxidizer feed can be designed with a low flow resistance. In addition, it is not necessary to arrange a separate fuel pump. The double blade wheel has a side substantially intended to cause the flow of the oxidizer and a side substantially intended to cause the flow of the fuel. Both sides can thus also be optimized for the intended purpose. In most cases (combustion of natural gas with air) a quantity of oxidizer considerably larger than the quantity of fuel will thus have to be pumped. In a specific embodiment the blades on the oxidizer side therefore have a larger surface area than the blades on the fuel side.

The present invention also provides a hot water appliance comprising a burner for heating water and a mixture supply system as described above. Examples of hot water appliances are central heating boilers, hot water boilers, geysers and combination boilers.

In a further embodiment the present invention provides a hot water appliance wherein substantially all the fuel combusted in the burner is supplied by the fan. In a specific embodiment only the fuel required for the pilot light is not supplied by the fan.

In an aspect according to the invention a method is provided for mixing a fluid fuel and a fluid oxidizer, comprising the steps of: providing a mixing chamber; supplying the oxidizer to the mixing chamber; and supplying the fuel to the mixing chamber; wherein the oxidizer and the fuel are separately supplied in forced manner to the mixing chamber.

According to a first aspect of the method according to the invention, the forced supply of the oxidizer and the fuel is effected by a fan with a fan chamber which functions as mixing chamber, wherein the oxidizer and the fuel are carried via separate exits into the fan chamber.

According to a further aspect of the invention, a method is provided further comprising the step of supplying the fuel to the mixing chamber by means of a second fan.

According to another aspect, the invention provides a method, wherein: the fan chamber is bounded by a fan housing comprising two walls located opposite each other and bounding the fan chamber in axial direction; and the fuel feed and the oxidizer feed each debouch in an opposite wall.

According to yet another aspect of the method according to the invention, the fan chamber comprises a blade wheel embodied as a double blade wheel, adapted such that the one side of the blade wheel substantially pumps the oxidizer and the other side of the blade wheel substantially pumps the fuel.

Further embodiments and advantages of the invention are discussed hereinbelow with reference to the accompanying figures, in which.

The basic idea behind the present invention is dictated by the fact that the design requirements of the gas feed and the air feed are partly contradictory. From a cost and energy perspective it is desired to utilize a small, low-power type of fan as fan for supplying air. This can be realized by selecting an air feed channel with a low airflow resistance, for instance by selecting an air feed with a large diameter. In the case pre-mixing takes place with a venturi, a low flow resistance has an adverse effect on the stability of the gas control block, since only a small underpressure is realized in the venturi. This results in a possible variation in the offset of the gas control block gaining a relatively great influence on the air/gas ratio. This is prevented by not allowing the gas to be drawn passively into a venturi upstream of the fan but supplying it actively or forcibly.

Figure 3:
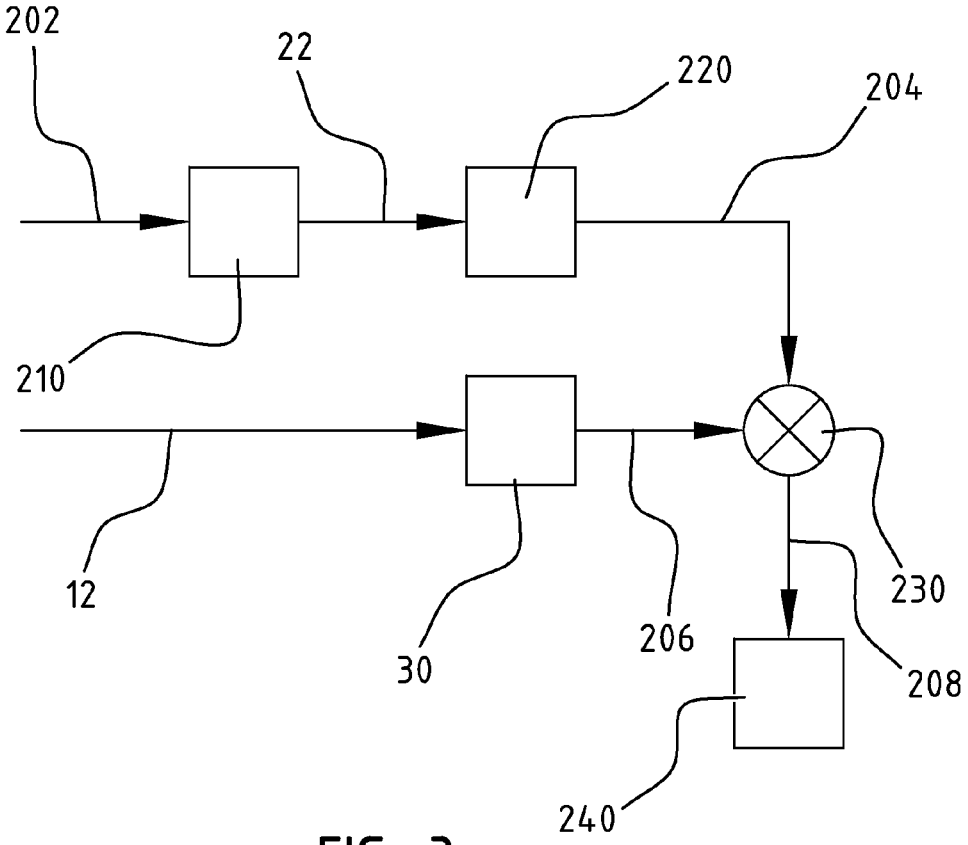
FIG. 3 shows a schematic diagram of an exemplary embodiment of the mixture supply system according to the invention.

This is achieved by using a separate fan 220 (FIG. 3) for the gas. The gas enters the hot water appliance via a feed conduit 202. It is here first guided through a gas control block 210 so that no inflow of gas takes place when the underpressure falls away in the boiler. A fan 220 extracts the gas from gas control block 210 via a conduit 22 and guides the gas further via a conduit 204 to a mixing chamber 230. The air is drawn in from a feed conduit 12 by a fan 30. Via a conduit 206 the indrawn air reaches mixing chamber 230, where the air mixes with the gas flowing in via conduit 204. Via conduit 208 the air/gas mixture finally reaches burner 240, where the gas is combusted. It is of course also possible not to apply any pre-mixing. In this case mixing chamber 230 is omitted and the air from conduit 204 and the gas from conduit 206 flow out directly into burner 240.

Figure 4:
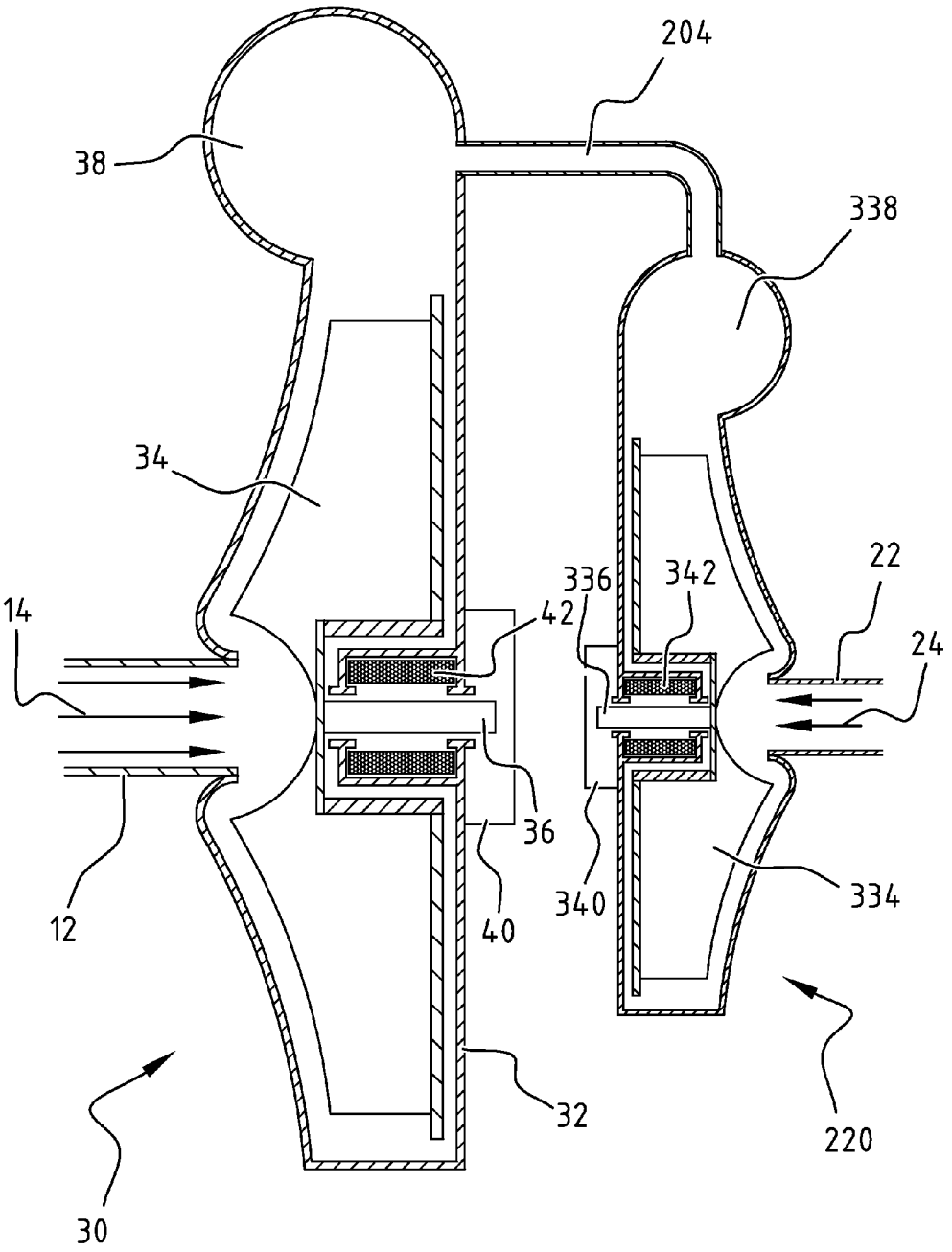
FIG. 4 shows a cross-section of a first exemplary embodiment of the mixture supply system according to the invention.

FIG. 4 shows an embodiment in which a separate fan 220 draws in gas from a gas feed 22 running from a gas control block. Gas flow 24 is generated by a blade wheel 334 which is driven by an electric motor 340 comprising, among other parts, a shaft 336 on which the blade wheel is arranged, and an electric coil 342 therearound. Gas leaves fan 220 from outlet 338 and reaches the outlet of fan 30 via a conduit 204. Fan 30 draws in air from an air feed 12. Airflow 14 is caused by blade wheel 34 which is arranged in fan housing 32 and driven by an electric motor 40 which comprises an electric coil 42 and the rotor 36 of which is connected to blade wheel 34 so that blade wheel 34 is driven. The air drawn in by fan 30 mixes in outlet 38 with the gas from conduit 204 and the air/gas mixture is guided further to the burner. Fans 220 and 30 as shown in FIG. 4 are of the centrifugal type. Other types of pump can of course also be used. Active gas injection takes place in the present invention instead of passive suction of gas by the air flow in the venturi.

Figure 5:
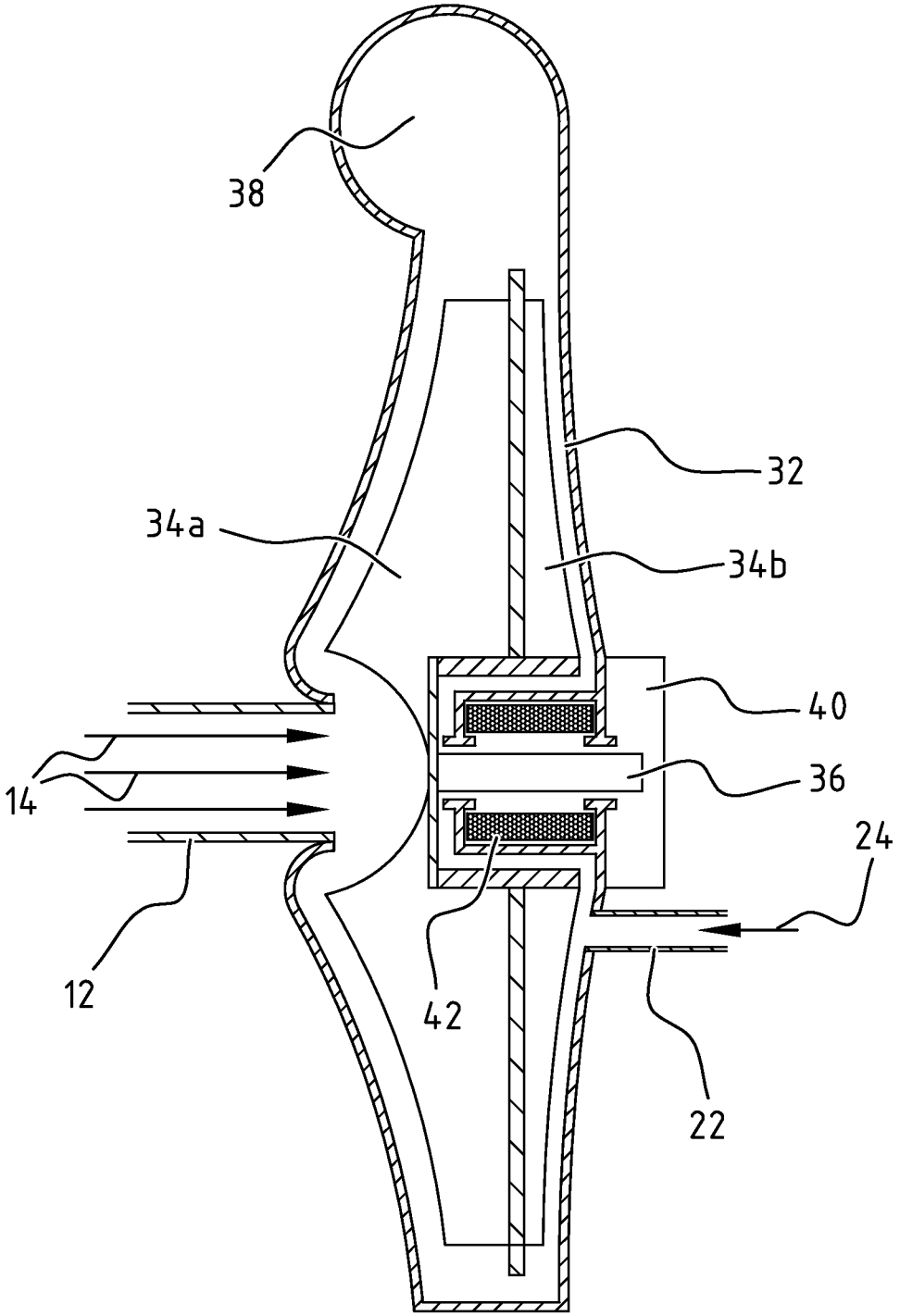
FIG. 5 shows a cross-section of a second exemplary embodiment of the mixture supply system according to the invention.

An alternative, but particularly advantageous embodiment is shown in FIG. 5. In this embodiment a single fan housing 32 is used which has therein a double blade wheel 34*a*, 34*b* driven by a single electric motor 40. Electric motor 40 comprises an electric coil 42 in which a rotor 36 rotates. The rotor is connected to double blade wheel 34*a*, 34*b*. On a first axial side the fan housing 32 comprises a wall with the exit of air feed 12 therein. The side 34*a* of the double blade wheel facing toward this first side causes airflow 14. On the second axial side the fan housing 32 further comprises a wall with the exit of gas feed 22 therein. The side 34*b* of the double blade wheel facing toward this second side causes a gas flow 24. The air and the gas mix on the periphery of blade wheel 34*a*, 34*b*, where the air/gas mixture once again leaves fan housing 32 via outlet 38 in order to flow into the burner.

Figure 1:
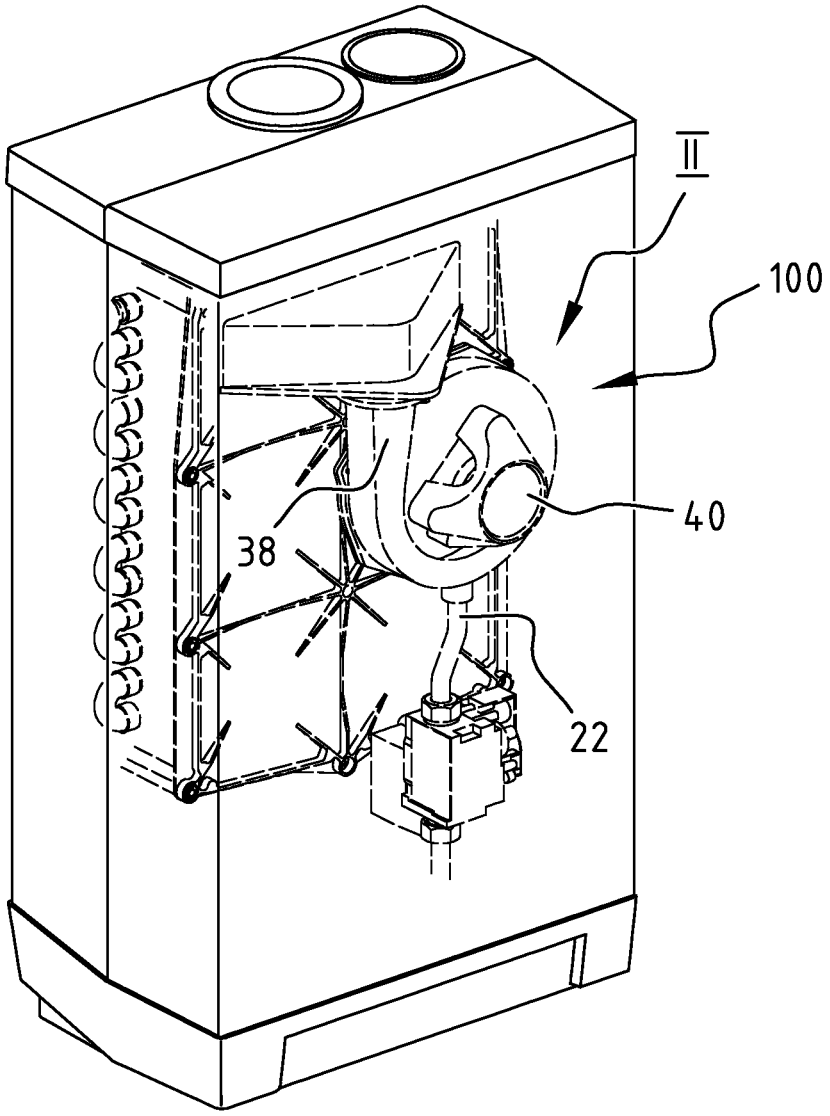
FIG. 1 shows a hot water appliance in which a mixture supply system according to the invention can be applied.
Figure 2:
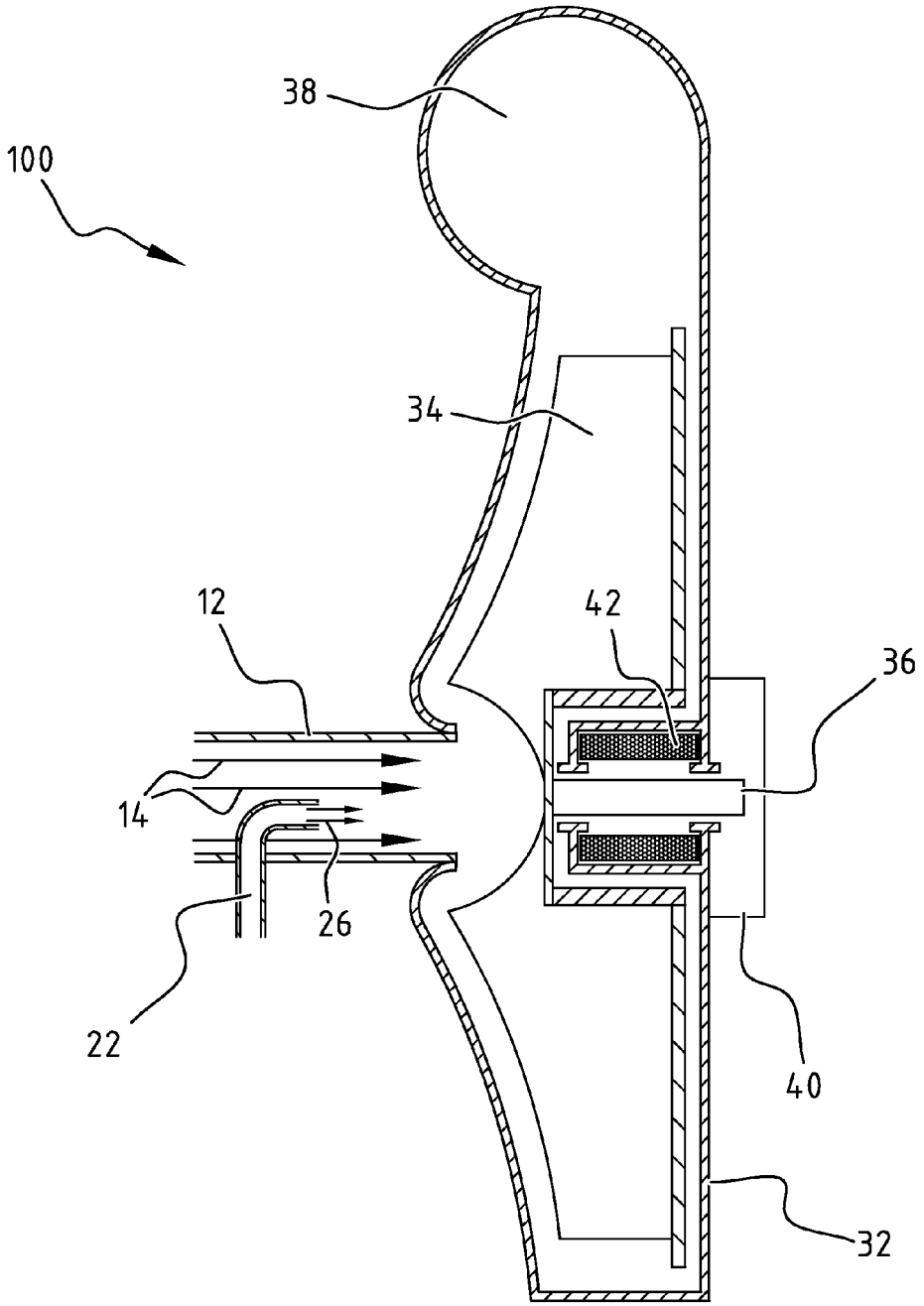
FIG. 2 shows a prior art mixture supply system.

Finally, FIG. 1 shows a combi-boiler for heating tap water and supplying hot central heating water, in which a fan 100 according to the invention is shown. A gas feed 22 guides gas from the gas control block to fan 100. Blade wheel 34*a*, 34*b* is driven by an electric motor 40. The air/gas mixture is guided via outlet 38 to the burner.

The embodiments shown and described herein are included solely as exemplary embodiments and should by no means be interpreted as being limitative for the invention. It will be apparent to the skilled person that many adjustments and modifications of the exemplary embodiments are possible within the invention. It is thus of course possible to combine features of different embodiments so as to thus obtain further embodiments according to the invention. It is further possible to mix the gas and the air in the housing of the air fan or in the outlet of the air fan. In addition, it is also possible to have the mixing take place only in the burner. The protection sought is therefore defined solely by the following claims.

The invention claimed is:

1. A mixture supply system which is adapted for mounting in a hot water appliance and which is adapted to supply a combustible mixture to a burner of the hot water appliance, the mixture supply system comprising:

a fuel feed for a fluid fuel;

an oxidizer feed for a fluid oxidizer;

a mixing chamber for mixing the fuel and the oxidizer in order to form the combustible mixture;

a discharge for discharging the combustible mixture from the mixing chamber; and a fan for urging the fuel and oxidizer from the respective feed to the mixing chamber, and urging the mixture therefrom to the discharge;

wherein:

the fan is adapted to act directly on both the fuel and the oxidizer;

the fan comprises a fan chamber provided with a blade wheel and a rotor, wherein the blade wheel is embodied as a double blade wheel adapted such that one side of the blade wheel substantially pumps the oxidizer and an opposing side of the blade wheel substantially pumps the fuel;

the fuel feed and the oxidizer feed each debouch in the fan chamber;

the mixing chamber is incorporated in the fan chamber and comprises two opposing walls located opposite each other and bounding the mixing chamber in axial direction;

the mixture discharge is orthogonal to both the fuel feed and oxidizer feed and connects to the fan chamber; and the fuel feed and oxidizer feed have separate exits into the mixing chamber; and further wherein:

the fan comprises a fan housing which bounds the fan chamber; and the fuel feed debouches from one of the opposing walls of the mixing chamber and the oxidizer feed debouches from a second of the opposing walls of the mixing chamber parallel to the rotational axis of the rotor.

2. The mixture supply system as claimed in claim 1, further comprising a fuel pump for forcing a fuel flow out of the fuel teed to the mixing chamber.

3. The mixture supply system as claimed in claim 2, wherein the fuel flow is mechanically forced.

4. The mixture supply system as claimed in claim 2, wherein the fuel pump per se comprises another fan.

5. The mixture supply system as claimed in claim 2, wherein the fuel pump is incorporated in the fuel feed and wherein the fuel pump is connected by means of a conduit to the mixing chamber.

6. The mixture supply system as claimed in claim 4, wherein the fuel pump is incorporated in the fan chamber.

7. The mixture supply system as claimed in claim 6, wherein the blade wheel is embodied as a double blade wheel adapted such that the one side of the blade wheel substantially pumps the oxidizer and the other side of the blade wheel substantially pumps the fuel.

8. The mixture supply system as claimed in claim 7, wherein the side of the blade wheel which pumps the oxidizer has larger blades than the side which pumps the fuel.

9. A hot water appliance, comprising a burner for heating water and a mixture supply system as claimed in claim 1.

10. The hot water appliance as claimed in claim 9, wherein substantially all the fuel combusted in the burner is supplied by the fan.

11. A method for mixing a fluid fuel and a fluid oxidizer, comprising the steps of:

providing a mixing chamber of a mixture supply system according to claim 1;

supplying the oxidizer to the mixing chamber; and supplying the fuel to the mixing chamber.

12. The method as claimed in claim 11, further comprising the step of supplying the fuel to the mixing chamber by means of a second fan.

* * * * *